US009989050B2

(12) United States Patent
Asayama et al.

(10) Patent No.: US 9,989,050 B2
(45) Date of Patent: Jun. 5, 2018

(54) FUEL INJECTION PUMP

(75) Inventors: Kazuhiro Asayama, Nagoya (JP); Takashi Usui, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days. days.

(21) Appl. No.: 14/236,586

(22) PCT Filed: Aug. 1, 2011

(86) PCT No.: PCT/JP2011/067601

§ 371 (c)(1),
(2), (4) Date: Jan. 31, 2014

(87) PCT Pub. No.: WO2013/018186

PCT Pub. Date: Feb. 7, 2013

(65) Prior Publication Data

US 2014/0199192 A1 Jul. 17, 2014

(51) Int. Cl.
*F04B 49/22* (2006.01)
*F02M 59/46* (2006.01)
(Continued)

(52) U.S. Cl.
CPC ..... *F04B 49/22* (2013.01); *F02M 59/462* (2013.01); *F04B 7/0053* (2013.01); *F04B 7/0076* (2013.01); *F04B 7/0266* (2013.01); *F04B 25/00* (2013.01)

(58) Field of Classification Search
CPC ..... F02M 63/0054; F02M 2200/60; F02M 59/367; F02M 59/485; F02M 63/0056;
(Continued)

(56) References Cited

U.S. PATENT DOCUMENTS 3,415,271 A * 12/1968 Maasberg ..... F04B 53/102 137/512
4,428,396 A * 1/1984 Wall ..... F16K 17/18 137/493

(Continued)

FOREIGN PATENT DOCUMENTS

CN 101135283 A 3/2008
EP 2497939 A1 9/2012

(Continued)

OTHER PUBLICATIONS

Partial translation of Written Opinion, dated Jul. 9, 2013, in PCT/JP2011/067601.

*Primary Examiner* — Devon Kramer
*Assistant Examiner* — Thomas Cash
(74) *Attorney, Agent, or Firm* — Hunton Andrews Kurth LLP

(57) ABSTRACT

A fuel injection pump is provided. The fuel injection pump includes a valve holder, a plunger, an inlet valve, an outlet valve, and a relief valve. The valve holder includes a pump chamber and a seat. The plunger configured to pressurize or depressurize the pump chamber. The inlet valve, the outlet valve, and the relief valve are arranged in an interior of the valve holder. The relief valve is provided on a downstream side of the outlet valve. The pump chamber is formed between the inlet valve and the outlet valve. The seat has a discharge passage and a return passage. The return passage is configured such that the fuel flows through the return passage from the downstream side of the outlet valve to an upstream side of the relief valve. The discharge passage and the return passage are formed offset from each other in the seat.

4 Claims, 6 Drawing Sheets

(51) Int. Cl.
*F04B 25/00* (2006.01)
*F04B 7/00* (2006.01)
*F04B 7/02* (2006.01)

(58) Field of Classification Search
CPC ..... F02M 63/0245; F02M 63/0265; F04B 49/22; F04B 53/10; F04B 53/1035; F04B 53/1032; F04B 7/0266; F04B 7/0053; F04B 7/0076; Y10T 137/778; Y10T 137/7794; Y10T 137/7838
USPC ..... 417/568
See application file for complete search history.

(56) References Cited

U.S. PATENT DOCUMENTS 6,289,875 B1* 9/2001 Shinohara ..... F02M 39/005 123/450
2006/0159573 A1* 7/2006 Inoue ..... F04B 53/10 417/505
2008/0056914 A1* 3/2008 Usui ..... F02M 55/04 417/307
2011/0126804 A1* 6/2011 Lucas ..... F02M 59/366 123/456
2011/0206547 A1* 8/2011 Kim ..... F04B 15/02 417/568
2012/0227711 A1 9/2012 Saito

FOREIGN PATENT DOCUMENTS

| | | | |
|---|---|---|---|
| GB | 2273134 | A | 6/1994 |
| JP | 55-063463 | U1 | 10/1978 |
| JP | 63-121774 | U | 8/1988 |
| JP | 06-213105 | A | 8/1994 |
| JP | 2003-035212 | A | 2/2003 |
| JP | 2004-036468 | A | 2/2004 |
| JP | 2006-291838 | A | 10/2006 |
| JP | 2008-057451 | A | 3/2008 |
| JP | 2009-103008 | A | 5/2009 |
| JP | 2009-257197 | A | 11/2009 |
| JP | 2012-184745 | A | 9/2012 |
| JP | 2013-167259 | A | 8/2013 |
| WO | 2011/068524 | A1 | 6/2011 |

* cited by examiner

FUEL INJECTION PUMP

CROSS-REFERENCE TO RELATED APPLICATIONS

This is a national phase application based on the PCT International Patent Application No. PCT/JP2011/067601 filed on Aug. 1, 2011, the entire contents of which are incorporated herein by reference.

TECHNICAL FIELD

The present invention relates to a fuel injection pump which supplies high-pressure fuel to a fuel injection valve of an engine.

BACKGROUND ART

Patent Document 1 discloses a fuel injection pump in which a plunger, an inlet valve, and an outlet valve are housed in a pump housing. An discharge side of the fuel injection pump is connected to a high-pressure delivery pipe, and a relief valve for preventing an excessive pressure increase of high-pressure fuel is provided in the high-pressure delivery pipe.

PRIOR TECHNICAL DOCUMENTS

Patent Documents

Patent Document 1: Japanese Patent Application Publication No. 2006-291838 (JP 2006-291838 A)

SUMMARY OF THE INVENTION

Problem to be Solved by the Invention

A technique disclosed in Patent Document 1 can reduce a pump size by providing the relief valve outside of the pump housing but requires fuel passages formed in systems of the inlet valve, the outlet valve, and the relief valve and between the valves to be independently arranged from each other.

In such a case, the number of components in a whole fuel injection device cannot be reduced, and as a result it is difficult to satisfy a demand for cost reduction.

The present invention provides a fuel injection pump which can reduce the number of components of the fuel injection pump and reduce cost.

Means for Solving the Problem

The present invention provides a fuel injection pump which pressurizes and discharges fuel that is drawn in a low-pressure state, the fuel injection pump including a pump housing having a valve holder in which an inlet valve, an outlet valve, and a relief valve are arranged in an interior and a pump chamber is formed between the inlet valve and the outlet valve and a plunger that pressurizes or depressurizes the pump chamber, in which the relief valve is provided on a downstream side of the outlet valve and is configured as a valve for returning the fuel to an upstream side of the outlet valve, and a portion of a passage on the upstream side of the outlet valve and a passage from the downstream side of the outlet valve to an upstream side of the relief valve are separately formed in a same space in the valve holder.

The inlet valve, the relief valve, and the outlet valve are preferably arranged in this order from an introduction side to a discharge side of the fuel in the valve holder, and a passage from the outlet valve side to the relief valve side and a passage from the relief valve side to the outlet valve side are preferably separately formed in a same space in a passage between the relief valve and the outlet valve.

The passage between the outlet valve and the relief valve is preferably formed with a single component.

An inside surface of the valve holder is preferably formed in a linear cylindrical shape that is orthogonal to a moving direction of the plunger, and the inlet valve, the outlet valve, and the relief valve are preferably arranged on an axis of the valve holder.

The valve holder preferably includes a stopper that supports an elastic body applying urging force to the inlet valve and an elastic body applying urging force to the relief valve.

Effect of the Invention

The present invention can reduce the number of components of the fuel injection pump and reduce cost.

MODES FOR CARRYING OUT THE INVENTION

A configuration of a fuel injection pump 1 will be described hereinafter with reference to FIGS. 1 to 3.

The fuel injection pump 1 is a high-pressure pump that pressurizes fuel (low-pressure fuel) supplied in a low-pressure state to form high-pressure fuel and supplies it to a fuel injection valve (high-pressure delivery). The fuel injection pump 1 is provided in an internal-combustion engine and functions as a fuel injection device for the internal-combustion engine along with the fuel injection valve and so forth.

Figure 1:
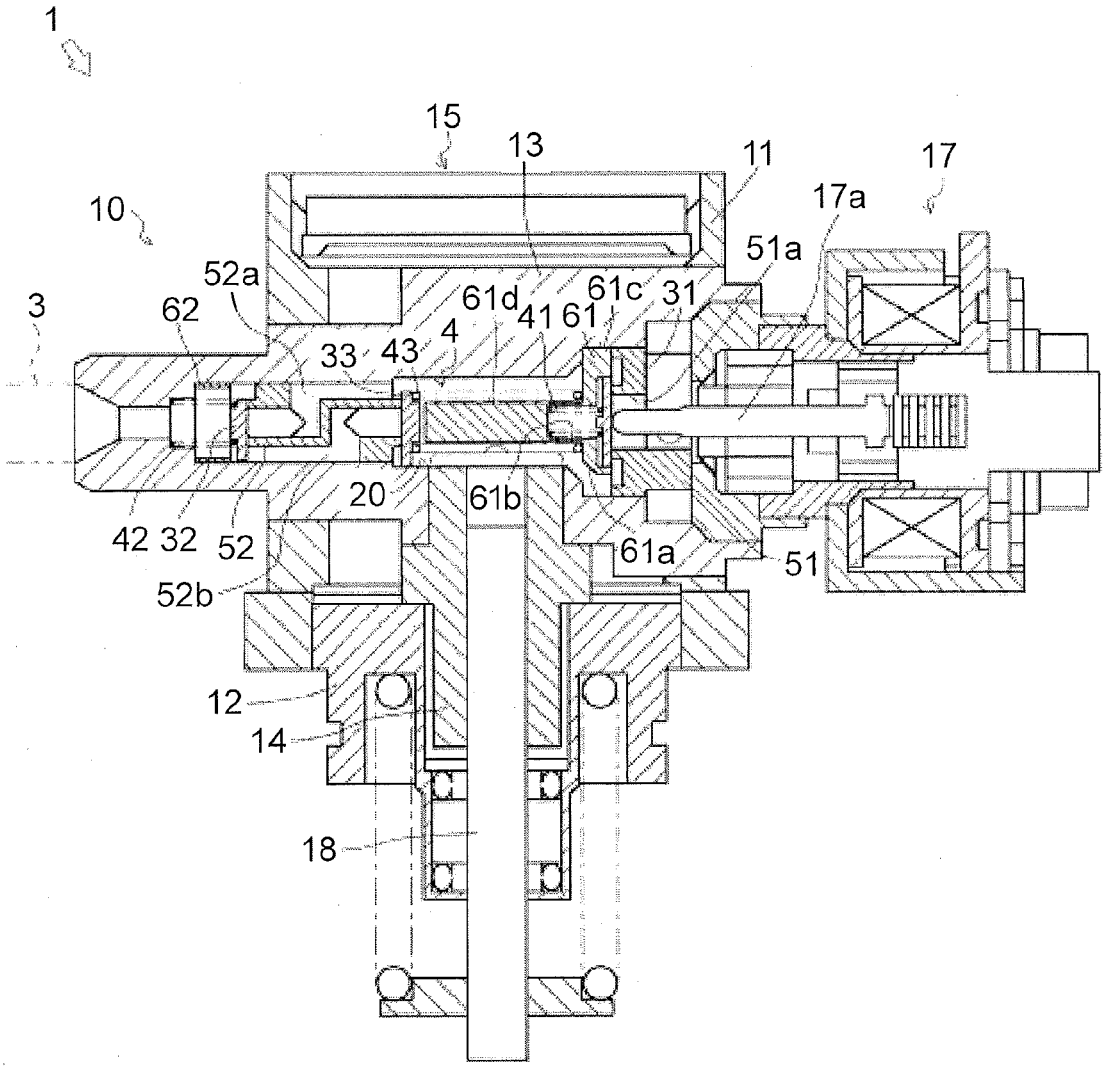
FIG. 1 is a cross-sectional side view of a fuel injection pump.
Figure 2:
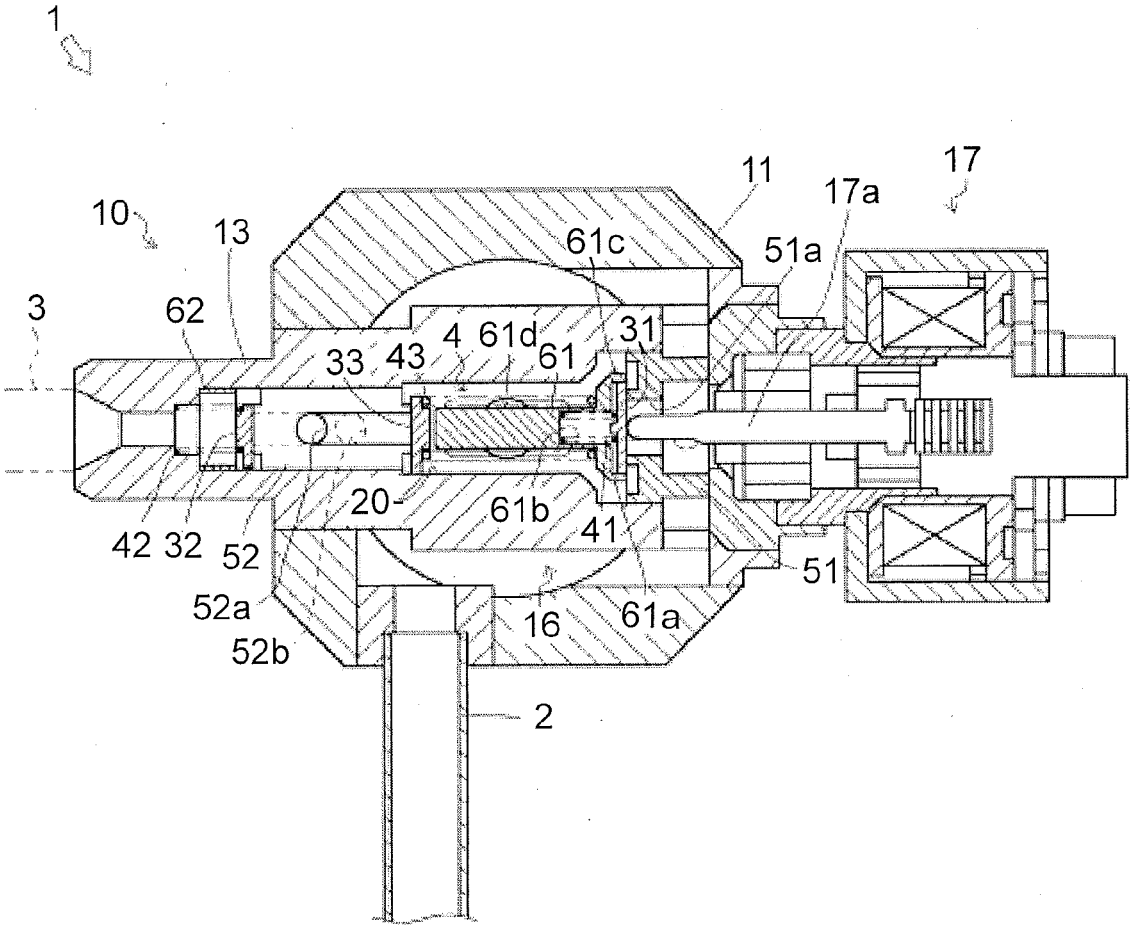
FIG. 2 is a cross-sectional plan view of the fuel injection pump.

As shown in FIGS. 1 and 2, a low-pressure delivery pipe 2 and a high-pressure delivery pipe 3 are connected to the fuel injection pump 1. The low-pressure delivery pipe 2 is connected to a fuel tank in which the fuel is stored. A feed pump such as the low-pressure pump or the like is used to draw the fuel from the fuel tank through the low-pressure delivery pipe 2 into the fuel injection pump 1. The high-pressure delivery pipe 3 is connected to the high-pressure delivery and discharges the high-pressure fuel from the fuel injection pump 1 via the high-pressure delivery pipe 3 to the high-pressure delivery.

In the fuel injection pump 1, a pump chamber 4 is provided in a passage from the low-pressure delivery pipe 2 to the high-pressure delivery pipe 3, and the high-pressure fuel that is pressurized in the pump chamber 4 is supplied to the high-pressure delivery via the high-pressure delivery pipe 3.

The fuel injection pump 1 includes a pump housing 10. The pump housing 10 is a structure that constitutes a main body of the fuel injection pump 1 and has a body 11, an oil seal holder 12, a valve holder 13, a cylinder 14, a pulsation damper 15, an inlet gallery chamber 16, an electromagnetic spill valve 17, and a plunger 18.

The body 11 is formed in a box shape, and an interior thereof is formed as a sealed space. The interior space of the body 11 is formed as the inlet gallery chamber 16, and a portion of the valve holder 13 and a portion of the cylinder 14 are arranged in the interior space.

The inlet gallery chamber 16 is formed inside the body 11 and are defined by an inside surface of the body 11 and outside surfaces of the valve holder 13 and the cylinder 14. The inlet gallery chamber 16 is connected to the low-pressure delivery pipe 2, and the low-pressure fuel drawn into the fuel injection pump 1 via the low-pressure delivery pipe 2 is supplied to the inlet gallery chamber 16.

The pulsation damper 15 is provided on one end surface of the body 11. The pulsation damper 15 is provided to face the inlet gallery chamber 16 and reduces pulsation of the low-pressure fuel supplied to the inlet gallery chamber 16, that is, pulsation of the fuel drawn into the fuel injection pump 1 via the feed pump.

The oil seal holder 12 is provided on an end surface that faces the one end surface on which the pulsation damper 15 is provided in the body 11. In other words, the two end surfaces facing each other in the body 11 are closed by the oil seal holder 12 and the pulsation damper 15.

The valve holder 13 has a cylindrical section 20 formed in a linear cylindrical shape. The pump chamber 4 is formed in the cylindrical section 20. An inlet valve 31, an outlet valve 32, a relief valve 33 are arranged in the cylindrical section 20 and are arranged on the axis of the valve holder 13. The pump chamber 4 is formed between the inlet valve 31 and the outlet valve 32.

The valve holder 13 is fixed to the body 11 while passing through the body 11 in a lateral direction. In other words, the valve holder 13 is arranged across the body 11.

The cylindrical section 20 is a section that defines an interior space of the valve holder 13, and an interior thereof is formed as a fuel passage through which the fuel flows. The cylindrical section 20 communicates with the inlet gallery chamber 16 on a fuel introduction side and communicates with the high-pressure delivery pipe 3 on a fuel discharge side.

An inside surface of the cylindrical section 20 is formed in a stepped shape having a plurality of steps in the axial direction, and the cross-sectional area of the inside surface stepwise decreases from the fuel introduction side toward the fuel discharge side. In the valve holder 13 (the cylindrical section 20), the inlet valve 31, the relief valve 33, and the outlet valve 32 are arranged in this order from the fuel introduction side to the fuel discharge side. Further, the cylindrical section 20 is configured such that the inner diameter of the inside surface varies (decreases) in sections where the inlet valve 31, the relief valve 33, and the outlet valve 32 are arranged.

An upstream side of the inlet valve 31 faces the inlet gallery chamber 16, and a downstream side faces the pump chamber 4. An upstream side of the outlet valve 32 faces the pump chamber 4, and a downstream side faces the high-pressure delivery pipe 3. An upstream side of the relief valve 33 faces the high-pressure delivery pipe 3, and a downstream side faces the pump chamber 4. As described above, the pump chamber 4 is formed from the downstream side of the inlet valve 31 to the upstream side of the outlet valve 32 in the cylindrical section 20 and formed to face all the valves 31, 32, 33.

The electromagnetic spill valve 17 is arranged at an end (an end on the fuel introduction side) of the valve holder 13, and the high-pressure delivery pipe 3 is connected to the other end (an end on the fuel discharge side).

The electromagnetic spill valve 17 is an actuator that gains linear driving force by reciprocal motion of a cylinder 17*a*, and the cylinder 17*a* abuts on a central section of the inlet valve 31. That is, the inlet valve 31 is moved and thereby opened or closed by drive of the electromagnetic spill valve 17.

The inlet valve 31 is a valve provided between the inlet gallery chamber 16 and the pump chamber 4 and held between a seat 51 and a stopper 61 via a spring 41. The inlet valve 31 is moveable along the axial direction of the valve holder 13 (the cylindrical section 20).

One end of the spring 41 is fixed to one side of the stopper 61, the other end is fixed to the inlet valve 31, and the spring 41 is supported therebetween. The spring 41 urges the inlet valve 31 to the electromagnetic spill valve 17 side and thereby urges the inlet valve 31 in its closing direction, that is, from the pump chamber 4 toward the inlet gallery chamber 16.

The electromagnetic spill valve 17 is driven, and external force is applied to the inlet valve 31, thereby moving the inlet valve 31 to the pump chamber 4 side against the urging force of the spring 41. Accordingly, the inlet valve 31 is opened, and the inlet gallery chamber 16 communicates with the pump chamber 4, thereby allowing the low-pressure fuel to be drawn into the pump chamber 4. A drive timing or the like of the electromagnetic spill valve 17 is appropriately set according to an operational characteristic of the fuel injection pump 1.

The seat 51 is a cylindrical member press-fitted into an inside surface (the cylindrical section 20) of the valve holder 13 and provided with a passage 51*a* at the center. The passage 51*a* is a portion of the fuel passage provided in the cylindrical section 20 and opens in the axial direction of the cylindrical section 20. The cylinder 17*a* of the electromagnetic spill valve 17 reciprocally moves in the passage 51*a*. The passage 51*a* can be opened and closed by the inlet valve 31, and the passage 51*a* of the seat 51 is turned into a communication state or a blocked state by driving the electromagnetic spill valve 17. When the electromagnetic spill valve 17 is not driven and the urging force of the spring 41 is acting, the passage 51*a* is sealed by the inlet valve 31.

The stopper 61 is press-fitted into and fixed to the inside surface (the cylindrical section 20) of the valve holder 13. The stopper 61 is capable of abutting on the inlet valve 31 and restricts movement of the inlet valve 31 by the abutting. In other words, the stopper 61 is a restriction member that determines the maximum displacement of the inlet valve 31. A passage 61*a* that communicates with the cylindrical section 20 in the axial direction and a recess 61*b* for fixing the spring 41 are provided in a portion of the stopper 61.

The passage 61*a* is the fuel passage that allows communication between the upstream side and the downstream side of the stopper 61 and is a communication passage for allowing the fuel entering from the inlet gallery chamber 16 to flow to the pump chamber 4 on the downstream side. The recess 61*b* is provided to face the inlet valve 31 and houses the spring 41 therein.

An outside surface of the stopper 61 is formed in a stepped shape and is configured with a large diameter section 61*c* that has the same outer diameter as the inner diameter of the cylindrical section 20 and is press-fitted into the cylindrical section 20 and a small diameter section 61*d* that has a gap from the inside surface of the cylindrical section 20. The small diameter section 61*c* is formed on the downstream side of the large diameter section 61*d*, that is, on the fuel discharge side. The passage 61*a* is provided to pass through a portion of the large diameter section 61*c* in the axial direction.

The outlet valve 32 is a valve provided between the pump chamber 4 and the high-pressure delivery pipe 3 and held between a seat 52 and a stopper 62 via a spring 42. A clearance is provided between an outer periphery of the discharge valve 32 and the inside surface of the valve holder 13, and the outlet valve 32 is capable of movement along the axial direction of the valve holder 13 (the cylindrical section 20).

One end of the spring 42 is fixed to one side of the stopper 62, the other end is fixed to the outlet valve 32, and the spring 42 is supported therebetween. The spring 42 urges the outlet valve 32 in its closing direction, that is, from the high-pressure delivery pipe 3 toward the pump chamber 4.

When the fuel pressurized in the pump chamber 4 presses the outlet valve 32 and the pressure exceeds the urging force of the spring 42, the spring 42 contracts to move the outlet valve 32 to the high-pressure delivery pipe 3 side. The outlet valve 32 is thereby opened, and the pump chamber 4 communicates with the high-pressure delivery pipe 3.

The seat 52 is a member press-fitted into the inside surface of the valve holder 13 (the cylindrical section 20) and constitutes the fuel passage between the relief valve 33 and the outlet valve 32. The seat 52 is provided with a passage 52*a* and a return passage 52*b*.

The passage 52*a* is the fuel passage from the pump chamber 4 to the high-pressure delivery pipe 3, and the return passage 52*b* is the fuel passage from the high-pressure delivery pipe 3 to the pump chamber 4. The passage 52*a* and the return passage 52*b* are arranged to be offset from each other in the seat 52 and are formed as separate passages in the same space.

The passage 52*a* and the return passage 52*b* together open in a central section on an axial end surface of the seat 52. In other words, the passage 52*a* and the return passage 52*b* open in an axial central section of the cylindrical section 20, and openings thereof are respectively arranged in a position corresponding to a central section of the outlet valve 32 and in a position corresponding to a central section of the relief valve 33.

When the urging force of the spring 42 is larger than the pressure of the fuel in the pump chamber 4, the passage 52*a* is sealed by the outlet valve 32.

Figure 3:
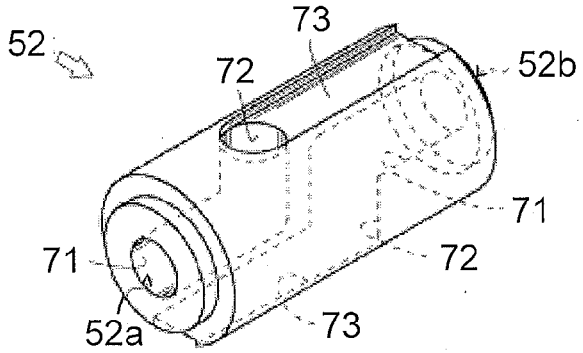
FIG. 3 illustrates a seat in which a passage between an outlet valve and a relief valve is formed.

An example of a configuration of the seat 52 that has such passage 52*a* and return passage 52*b* is a configuration shown in FIG. 3.

The seat 52 has a columnar shape, in which the passage 52*a* and the return passage 52*b* are symmetrically provided. Specifically, the passage 52*a* is formed with a lateral hole 71 that extends from a central section of one end surface of the seat 52 to a section adjoining an axial central section, a vertical hole 72 that reaches from a bottom of the lateral hole 71 to an outer peripheral surface, and a notch 73 provided in the outer peripheral surface. That is, passages are formed from one end side of the seat 52 to the other end side in the order of the lateral hole 71, the vertical hole 72, and the notch 73. The return passage 52*b* is provided to have a symmetrical shape of the passage 52*b* with respect to the axis of the seat 52 and are similarly formed with the lateral hole 71, the vertical hole 72, and the notch 73.

The seat 52 in the above configuration is press-fitted into the inside surface of the valve holder 13, an outer periphery of the seat 52 and an inner periphery of the valve holder 13 are thereby sealed, and the passage 52*a* and the return passage 52*b* independent from each other are thus formed between both of the ends of the seat 52.

The stopper 62 is a cylindrical member press-fitted into the inside surface of the valve holder 13 (the cylindrical section 20). The stopper 62 is capable of abutting on the outlet valve 32 and restricts movement of the outlet valve 32 by the abutting. In other words, the stopper 62 determines the maximum displacement of the outlet valve 32. The stopper 62 is not only arranged as an independent member but may also be configured to abut on the outlet valve 32 by using a stepped section formed on the inside surface of the cylindrical section 20.

The relief valve 33 is a valve provided between the high-pressure delivery pipe 3 and the pump chamber 4 and held between the seat 52 and the stopper 61 via a spring 42.

The spring 43 is arranged around the small diameter section 61*d* of the stopper 61. One end of a spring 61 is fixed to an end surface of the large diameter section 61*c* of the stopper 61, the other end is fixed to the relief valve 33, and the spring 61 is supported therebetween. The spring 43 urges the relief valve 33 in its closing direction, that is, from the pump chamber 4 to the high-pressure delivery pipe 3 side.

The high-pressure fuel discharged to the high-pressure delivery pipe 3 faces the relief valve 33 through the return passage 52*b*. When the pressure of the high-pressure fuel exceeds the urging force of the spring 43, the spring 43 contracts, and the relief valve 33 thereby opens. Accordingly, the high-pressure delivery pipe 3 communicates with the pump chamber 4. As described above, an actuation of the relief valve 33 prevents an excessive pressure increase of the high-pressure fuel that flows through the high-pressure delivery pipe 3. On the other hand, when the urging force of the spring 43 is larger than the pressure of the fuel in the high-pressure delivery pipe 3, the return passage 52*b* is sealed by the relief valve 33.

The oil seal holder 12 is a cylindrical member and has the cylinder 14 provided therein.

The cylinder 14 is formed in a cylindrical shape and slidably houses the plunger 18 therein along the axial direction. The cylinder 14 is arranged such that an opening end section faces the inside surface of the cylindrical section 20 of the valve holder 13 and is connected to an intermediate section of the valve holder 13. The cylinder 14 is arranged such that its axial direction is orthogonal to the axial direction of the valve holder 13 (the cylindrical section 20). In other words, the positional relationship between the cylinder 14 and the valve holder 13 is determined such that a slide direction of the plunger 18 is orthogonal to the axial direction of the valve holder 13 (the cylindrical section 20).

Further, the pump chamber 4 is formed between an end surface of the plunger 18 and an inside surface of the cylinder 14 and the inside surface of the cylindrical section 20. The plunger 18 slides along the axial direction of the cylinder 14, thereby changing the volume of the pump chamber 4. In other words, the pressure in the pump chamber 4 is increased or decreased in response to the slide of the plunger 18, and the fuel in the pump chamber 4 is pressurized and discharged in a pressurized state. Further, in a depressurized state, the pump chamber 4 is depressurized in a state where the electromagnetic spill valve 17 is driven, and the inlet valve 31 thereby opens, and the inlet gallery chamber 16 communicates with the pump chamber 4, thereby drawing the fuel into the pump chamber 4.

Next, flow of the fuel in the fuel injection pump 1 will be described with reference to FIGS. 4 to 6.

Figure 4:
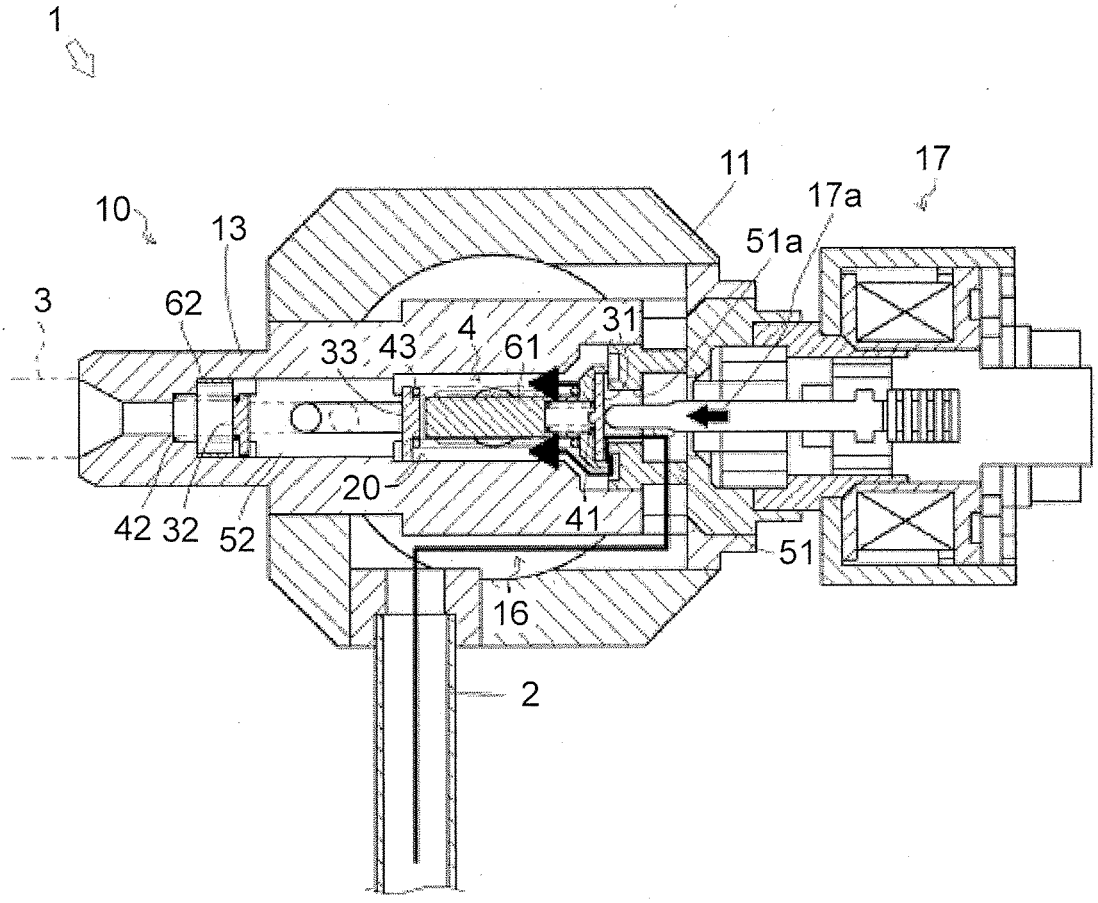
FIG. 4 illustrates an operation in the fuel injection pump during fuel introduction.

As shown in FIG. 4, the electromagnetic spill valve 17 is driven to move the cylinder 17*a* in a state where the low-pressure fuel is drawn from the low-pressure delivery pipe 2 into the inlet gallery chamber 16, thereby moving the inlet valve 31 in its opening direction. The inlet valve 31 is opened, and the low-pressure fuel is drawn from the inlet gallery chamber 16 into the pump chamber 4. At this point, the plunger 18 slides in a direction in which the volume of the pump chamber 4 is increased, thereby depressurizing the pump chamber 4.

The low-pressure fuel then passes from the inlet gallery chamber 16 through the inlet valve 31, the passage 51*a* of the seat 51, and the passage 61*a* of the stopper 61 and is supplied to the pump chamber 4.

Figure 5:
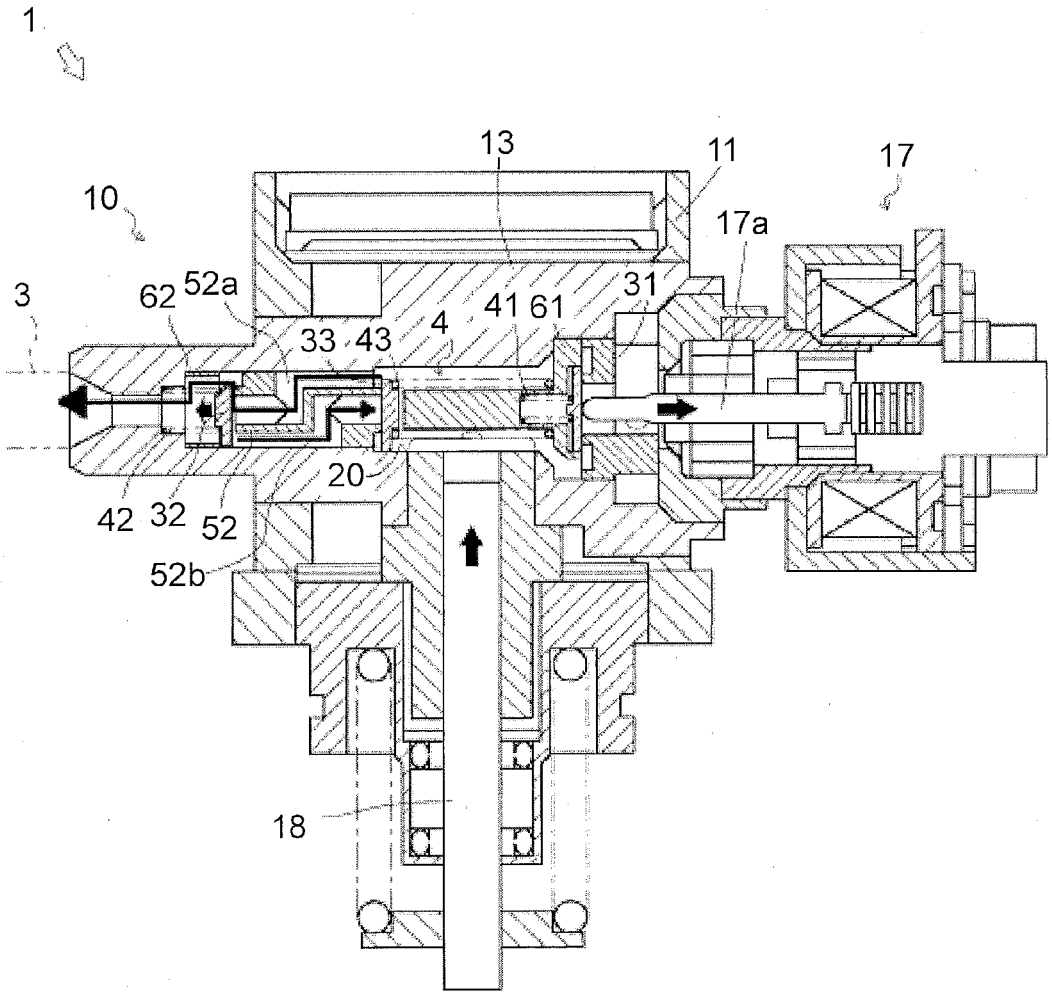
FIG. 5 illustrates an operation in the fuel injection pump during fuel discharge.

As shown in FIG. 5, the pump chamber 4 is compressed by the slide of the plunger 18, and the low-pressure fuel drawn into the pump chamber 4 is pressurized. At this point, the fuel in the pump chamber 4 reaches the upstream side of the outlet valve 32 through the passage 52*a*.

When the pressure of the fuel in the pump chamber 4 exceeds the urging force of the spring 42, the outlet valve 32 moves and opens. The outlet valve 32 opens to allow the pump chamber 4 to communicate with the high-pressure delivery pipe 3, thereby discharging the high-pressure fuel to the high-pressure delivery pipe 3. At this point, the high-pressure fuel discharged to the high-pressure delivery pipe 3 side faces the relief valve 33 via the return passage 52*b* of the seat 52.

Figure 6:
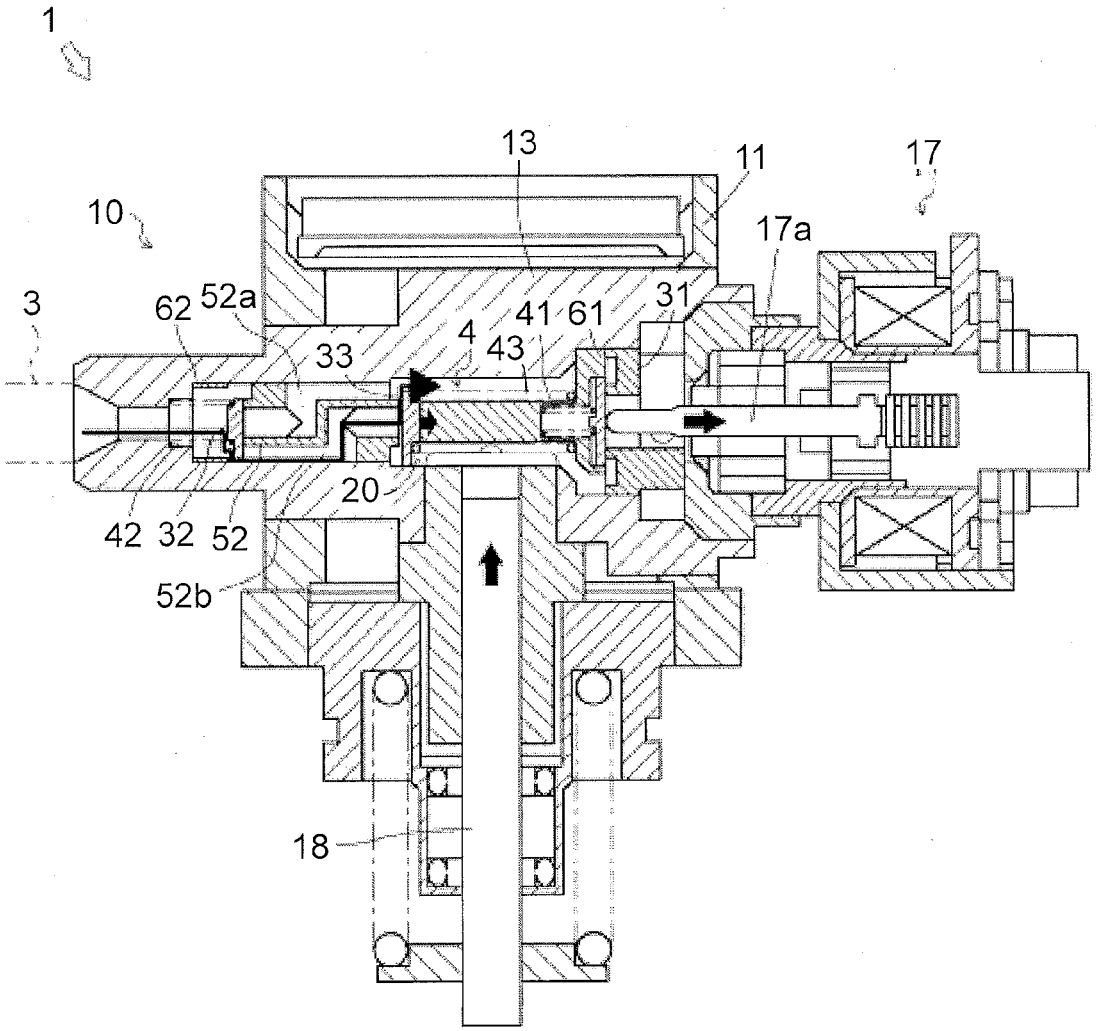
FIG. 6 illustrates an operation of the relief valve in the fuel injection pump.

As shown in FIG. 6, when the pressure of the high-pressure fuel in the high-pressure delivery pipe 3 increases and exceeds the urging force of the spring 43, the relief valve 33 is pressed by the pressure of the fuel to move in its opening direction. Accordingly, the high-pressure delivery pipe 3 communicates with the pump chamber 4, and the high-pressure fuel is returned to the pump chamber 4 through the return passage 52*b*.

As described above, the relief valve 33 and the outlet valve 32 share the seat 52 in the fuel injection pump 1. Further, the relief valve 33 and the inlet valve 31 share the stopper 61.

As described above, sharing portions of components that constitute systems of the valves 31, 32, 33 allows reduction in the number of components and contributes to size reduction of the fuel injection pump 1.

More specifically, the passage 52*a* from the relief valve 33 side to the outlet valve 32 side and the return passage 52*b* from the outlet valve 32 side to the relief valve 33 side are formed in the seat 52, and the relief valve 33 and the outlet valve 32 are configured such that the passage 52*a* and the return passage 52*b* are separated not to interfere with each other in a single component. Accordingly, the necessary components for the two valves 32, 33 are thereby shared.

This allows reduction in the number of components that constitute the systems of the essential valves for the fuel injection pump 1, cost reduction, and reduction in processing cost.

Further, in the inlet valve 31 and the relief valve 33, the spring receiving section of the spring 41 that presses the inlet valve 31 and the spring 43 that presses the relief valve 33 is formed with a single component of the stopper 61, and the necessary components for the two valves 31, 33 are shared.

This allows reduction in the number of components that constitute the systems of the essential valves for the fuel injection pump 1, cost reduction, and reduction in processing cost.

Further, because the seat 52 and the stopper 61 that are press-fitted into and fixed to the cylindrical section 20 are shared, it is not required to change the spring constants, strength, and the like of the springs 41, 42, 43 that urge the respective valves 31, 32, 33, thereby preventing an unnecessary size increase. This allows the fuel injection pump 1 to retain a small size and allows the dead volume of the pump to be small.

The valve holder 13 (the cylindrical section 20) is formed in a linear cylindrical shape, and the inlet valve 31, the outlet valve 32, and the relief valve 33 are coaxially arranged on the axis of the valve holder 13 (cylindrical section 20).

As described above, the three valves 31, 32, 33 are arranged in the cylindrical section 20, assembling work for the interior of the cylindrical section 20 can thereby be simplified, and processing work for processing the cylindrical section 20 in the valve holder 13 can thereby be simplified.

Further, the systems of the outlet valve 32, the relief valve 33, and the inlet valve 31 are sequentially and in one direction attached into the cylindrical section 20 having the inside surface in the stepped shape whose inner diameter increases from the fuel discharge side toward the fuel introduction side. Accordingly, assemblability can be improved.

Moreover, pressure receiving sections of the outlet valve 32 and the relief valve 33 that contact the fuel are set in central sections of the valves. This allows simple calculation of the pressure applied to the central section of the valves 32, 33 and facilitates adjustment of valve opening pressure.

The fuel from the relief valve 33 is returned from the high-pressure delivery pipe 3 to the pump chamber 4, and the difference between the pressure of the high-pressure fuel returned through the relief valve 33 and the pressure of the high-pressure fuel in the pump chamber 4 can be made small. Because a large volume of the pump chamber 4 is secured in the valve holder 13, the differential pressure of the high-pressure fuel can be absorbed by the volume of the pump chamber 4.

Further, the fuel from the relief valve 33 directly flows into the pump chamber 4 that faces the relief valve 33 through the return passage 52*b* of the seat 52. Therefore, it is not required to separately provide a fuel return passage, and this contributes to size reduction of the fuel injection pump 1.

Another embodiment of the fuel injection pump 1 will next be described with reference to FIG. 7. In the above embodiment, the configuration where the seat 52 and the stopper 61 are shared is described. However, as, shown in FIG. 7(*a*) and FIG. 7(*b*), the outlet valve 32 and the relief valve 33 may be configured to share the seat 52.

Figure 7A:
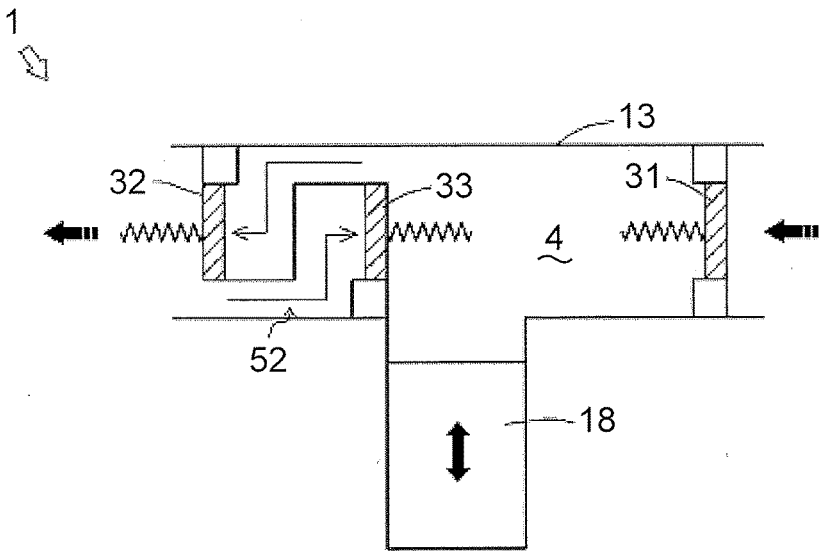
FIG. 7 is a schematic diagram for illustrating another embodiment of the fuel injection pump.
Figure 7B:
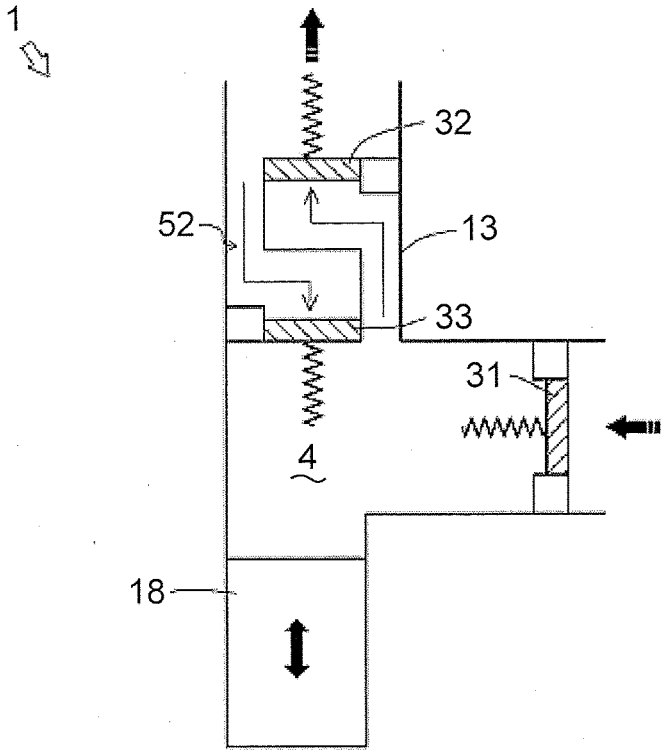

As shown in FIG. 7(*a*), the seat 52 is shared by the outlet valve 32 and the relief valve 33, and a large space between the inlet valve 31 and the relief valve 33 is provided. Accordingly, the large volume of pump chamber 4 can be obtained, and a large output of the fuel injection pump 1 can be obtained. In this case, sharing the seat 52 also allows reduction in the number of components and cost reduction.

As shown in FIG. 7(*b*), the cylindrical section 20 is not formed in the linear cylindrical shape but in a curved cylindrical shape, and the pump chamber 4 along the moving direction of the plunger 18 is formed, thereby allowing a smooth compression process of the pump chamber 4.

INDUSTRIAL APPLICABILITY

The present invention can be used for a fuel injection pump which supplies high-pressure fuel to a fuel injection valve of an engine.

DESCRIPTION OF REFERENCE NUMERALS AND SYMBOLS

1: fuel injection pump
2: low-pressure delivery pipe
3: high-pressure delivery pipe
10: pump housing
18: plunger
20: cylindrical section
31: inlet valve
32: outlet valve
33: relief valve
41, 42, 43: spring
51, 52: seat
52*a*: passage
52*b*: return passage
61, 62: stopper

The invention claimed is:

1. A fuel injection pump which pressurizes and discharges fuel that is drawn in a low-pressure state, the fuel injection pump comprising:

a pump housing;

a valve holder including a pump chamber and a seat;

a plunger configured to pressurize or depressurize the pump chamber;

an inlet valve arranged in an interior of the valve holder;

an outlet valve arranged in an interior of the valve holder; and a relief valve arranged in an interior of the valve holder, the relief valve being provided on a downstream side of the outlet valve, the relief valve being configured to return the fuel to an upstream side of the outlet valve, wherein the pump chamber is formed between the inlet valve and the outlet valve, the seat has a discharge passage and a return passage, the return passage is configured such that the fuel flows through the return passage from the downstream side of the outlet valve to an upstream side of the relief valve, the discharge passage and the return passage are formed offset from each other in the seat, the valve holder includes a stopper, the stopper is configured to support a first elastic body and a second elastic body, the first elastic body is configured to apply urging force to the inlet valve, the second elastic body is configured to apply urging force to the relief valve, and the stopper is configured such that there is a gap around at least a portion of the stopper extending in an axial direction between the stopper and an inside surface of the valve holder.

2. The fuel injection pump according to claim 1, wherein the inlet valve, the relief valve, and the outlet valve are arranged in this order from an introduction side to a discharge side of the fuel in the valve holder, and the discharge passage and the return passage are arranged between the relief valve and the outlet valve.

3. The fuel injection pump according to claim 2, wherein the seat is a single component.

4. The fuel injection pump according to claim 1, wherein an inside surface of the valve holder has a linear cylindrical shape, the inside surface is orthogonal to an axial direction of the plunger, and the inlet valve, the outlet valve, and the relief valve are arranged on an axis of the valve holder.

* * * * *